US012144420B1

(12) United States Patent
Fu

(10) Patent No.: US 12,144,420 B1
(45) Date of Patent: Nov. 19, 2024

(54) STORAGE DEVICE

(71) Applicant: Qianming Fu, Shenzhen (CN)

(72) Inventor: Qianming Fu, Shenzhen (CN)

( * ) Notice: Subject to any disclaimer, the term of this patent is extended or adjusted under 35 U.S.C. 154(b) by 0 days.

(21) Appl. No.: 18/636,409

(22) Filed: Apr. 16, 2024

(51) Int. Cl.
*A47B 43/04* (2006.01)
*A47B 81/00* (2006.01)

(52) U.S. Cl.
CPC ..... *A47B 43/04* (2013.01); *A47B 81/002* (2013.01)

(58) Field of Classification Search
CPC ..... A47B 43/04; A47B 81/002
See application file for complete search history.

(56) References Cited

U.S. PATENT DOCUMENTS 164,640 A * 6/1875 Coburn ..... A47B 43/04 312/238
651,344 A * 6/1900 Dils ..... A47B 43/04 211/90.01
802,211 A * 10/1905 Henrioud ..... A47B 43/04 312/238
1,030,033 A * 6/1912 Tallman ..... A47B 43/04 211/90.03
1,064,928 A * 6/1913 Pape ..... A47B 43/04 312/6
1,141,468 A * 6/1915 Lawton ..... A47B 43/04 312/238
1,425,228 A * 8/1922 Altman ..... A47B 43/04 312/238
1,529,550 A * 3/1925 Pyleck ..... A47B 43/04 312/6
1,569,406 A * 1/1926 Sonntag ..... A47B 43/04 211/180
1,600,408 A * 9/1926 Grieshaber ..... A47B 81/002 312/238
1,663,949 A * 3/1928 Lawton ..... A47B 81/002 211/180
1,718,263 A * 6/1929 Summers ..... A47F 1/08 222/129
2,639,819 A * 5/1953 Marks ..... A47B 43/04 211/186
2,944,863 A * 7/1960 Bertelsen ..... A47B 61/00 211/144
3,066,995 A * 12/1962 Derman ..... A47B 43/04 312/297

(Continued)

FOREIGN PATENT DOCUMENTS

CH 444409 A * 9/1967
FR 1452269 A * 2/1966

(Continued)

*Primary Examiner* — Stanton L Krycinski
(74) *Attorney, Agent, or Firm* — Daniel M. Cohn; Howard M. Cohn

(57) ABSTRACT

A storage device includes a mounting component, a storage component, and at least one elastic piece. The mounting component and the storage component are mounted on wall surfaces at intervals in a gravity direction. The at least one elastic piece is connected between the mounting component and the storage component. The at least one elastic piece, the mounting component, and the storage component are enclosed to define a storage space. Under driving of an external force, the at least one elastic pieces is deformed to define an entrance of the storage space. The storage device prevents articles stored therein from falling, thus reducing a potential safety hazard.

19 Claims, 9 Drawing Sheets

(56) References Cited

U.S. PATENT DOCUMENTS 3,519,318 A * 7/1970 Hagen ..... A47B 43/04 312/213
3,679,280 A * 7/1972 Friederich ..... A47B 43/04 312/3
3,938,872 A * 2/1976 Hagerman ..... F25D 23/069 211/105.6
3,994,331 A * 11/1976 Zieminski ..... A47B 61/00 160/351
5,601,198 A * 2/1997 Reed ..... A47B 96/02 211/183
5,678,904 A * 10/1997 Hung ..... A47B 43/04 135/121
5,718,490 A * 2/1998 Liao ..... A47B 43/04 135/157
5,791,501 A * 8/1998 Baldwin, Jr. ..... A47F 5/132 211/183
5,984,121 A * 11/1999 Cole ..... B65G 1/02 211/183
6,098,750 A * 8/2000 Reynolds ..... E04G 21/3261 182/138
6,123,294 A * 9/2000 Genovese ..... B64D 9/00 244/118.1
6,543,864 B2 * 4/2003 Cline ..... A47B 43/04 312/3
6,585,122 B2 * 7/2003 Calleja ..... A47F 5/01 211/183
6,585,333 B1 * 7/2003 Wang ..... A47B 43/04 312/297
6,609,621 B2 * 8/2003 Denny ..... B65G 1/02 211/183
6,702,119 B2 * 3/2004 Sabounjian ..... A47B 61/06 190/126
6,722,512 B2 * 4/2004 Scully ..... A47F 5/13 211/183
7,008,154 B1 * 3/2006 Nolle ..... B60R 7/005 410/97
7,014,053 B2 * 3/2006 Calleja ..... F16P 1/00 182/138
7,191,907 B2 * 3/2007 Conway ..... B65G 1/02 182/138
8,468,927 B2 * 6/2013 Malone ..... F41H 5/023 89/36.02
9,033,106 B2 * 5/2015 Blinn ..... E04G 21/3233 182/138
10,327,389 B1 * 6/2019 Brownscombe ..... F26B 9/10
10,413,068 B2 * 9/2019 King ..... B65G 1/02
2004/0113528 A1 * 6/2004 Wang ..... E05D 15/26 312/297
2004/0182809 A1 * 9/2004 Calleja ..... A47F 5/132 211/183
2004/0211740 A1 * 10/2004 Denny ..... B65G 1/02 211/183
2005/0088064 A1 * 4/2005 Jacklin ..... A47B 43/04 312/265.4
2006/0022559 A1 * 2/2006 Mallen ..... A47B 43/04 312/60
2007/0187349 A1 * 8/2007 Calleja ..... A47B 96/00 211/180
2008/0174214 A1 * 7/2008 Segall ..... A47B 43/04 312/6
2010/0102015 A1 * 4/2010 Benneche ..... A47B 97/00 211/183
2013/0121785 A1 * 5/2013 Coury ..... B60P 7/06 410/97
2015/0014264 A1 * 1/2015 Linnell, Sr. ..... B62B 3/005 108/147.11

FOREIGN PATENT DOCUMENTS

FR 1445789 A * 7/1966
FR 1467955 A * 2/1967
FR 2045241 A5 * 2/1971
FR 2123723 A5 * 9/1972
FR 2157204 A5 * 6/1973
FR 2429573 A1 * 1/1980
FR 2886630 A1 * 12/2006 ..... A01G 13/043
GB 190928444 A * 6/1910
GB 174708 A * 1/1922
GB 839312 A * 6/1960
GB 1058962 A * 2/1967

* cited by examiner

STORAGE DEVICE

TECHNICAL FIELD

The present disclosure relates to a technical field of homehold storage device, and in particular to a storage device.

BACKGROUND

Storage devices cleverly utilizes an accommodating space therein for organization and storage, thereby being favored by people and widely used in people's home life.

In the prior art, articles placed on storage devices are prone to falling, posing safety hazards. Therefore, how to design a storage device that can reduce the safety hazards is an urgent problem to be solved.

SUMMARY

In views of defects in the prior art, the present disclosure provides a storage device to reduce safety hazards.

The storage device comprises a mounting component, a storage component, and at least one elastic piece.

The mounting component and the storage component are mounted on wall surfaces at intervals in a gravity direction. The at least one elastic piece is connected between the mounting component and the storage component. The at least one elastic piece, the mounting component, and the storage component are enclosed to define a storage space. Under driving of an external force, the at least one elastic pieces is deformed to define an entrance of the storage space.

In some embodiments, the at least one elastic piece comprises only one elastic piece and the one elastic piece is an elastic rope. The elastic piece is staggered and alternately connected to the mounting component and the storage component. Portions of the one elastic piece located between the mounting component and the storage component are defined as elastic portions. Any one of the elastic portions is deformable to define the entrance of the storage space.

In some embodiments, through holes are defined on the mounting component and the storage component. The through holes defined on the mounting component are staggered with the through holes defined on the storage component. The one elastic piece alternately passes through the through holes defined on the mounting component and the through holes defined on the storage component to connect the mounting component with the storage component.

In some embodiments, the at least one elastic piece comprises at least two elastic pieces. The at least two elastic pieces are disposed along an outer side edge of the mounting component.

In some embodiments, through holes are defined on the mounting component and the storage component. The through holes defined on the mounting component are one-to-one corresponding to the at least two elastic pieces. The through holes defined on the storage component are one-to-one corresponding to the at least two elastic pieces. Each of the elastic pieces passes through a corresponding through hole defined on the mounting component and a corresponding through hole defined on the storage component.

In some embodiments, the at least two elastic pieces are elastic ropes. Each of the elastic pieces is fixed to the corresponding through hole defined on the mounting component and the corresponding through hole defined on the storage component by knotting.

In some embodiments, the through holes defined on the mounting component and the through holes defined on the storage component are stepped holes. Each of the elastic pieces comprises an elastic portion and mounting portions disposed at two opposite ends of the elastic portion. Each elastic portion is an elastic net. Each of the mounting portions passes through a corresponding through hole and is snapped on a hole wall of the corresponding through hole.

In some embodiments, limiting grooves are defined on the mounting component and the storage component. The limiting grooves are one-to-one communicated with the through holes. Each of the elastic pieces further comprises limiting portions respectively connected to the mounting portions thereof, each of the limiting portions is located in a corresponding limiting groove.

In some embodiments, the mounting component and the storage component are foldable structures. The mounting component and the storage component are mounted on the wall surfaces at intervals in the gravity direction when unfolded.

In some embodiments, the mounting component is symmetrical and is foldable along a perpendicular bisector perpendicular to an outer side edge thereof. The storage component is symmetrical and is foldable along a perpendicular bisector perpendicular to an outer side edge thereof.

In some embodiments, the mounting component comprises two first foldable structures. The storage components comprises two second foldable structures. The two first foldable structures are connected by at least one first hinge. The two second foldable structures are connected by at least one second hinge.

In some embodiments, an inner side edge and an outer side edge of the mounting component are disposed in parallel. The inner side edge and the outer side edge of the mounting component are connected to the wall surfaces intersecting at a wall corner.

In some embodiments, an inner side edge of the storage component is a right-angled edge. The inner side edge of the storage component is configured to attach to a wall corner of a right angle.

In some embodiments, a structure of an outer side edge of the mounting component is same as a structure of an outer side edge of the storage component. The outer side edge of the mounting component and the outer side edge of the storage component are aligned and disposed in parallel in the gravity direction.

In some embodiments, a shape of the storage component is same as a shape of the mounting component. The storage component and the mounting component are fan-shaped, right-angled triangle, or rectangular.

In some embodiments, a shape of the storage component differs from a shape of the mounting component. The storage component and the mounting component are fan-shaped, right-angled triangle, or rectangular.

In some embodiments, a connection between an inner side edge and an outer side edge of the storage component is chamfered, and/or a connection between an inner side edge and an outer side edge of the mounting component is chamfered.

In some embodiments, fixing pieces are disposed on the mounting component and the storage component. The fixing pieces are configured to connect to the wall surfaces.

In some embodiments, at least one of the mounting component and the storage component comprises at least one hollow portion for weight reduction.

In some embodiments, the storage device further comprises a power supply and a light strip. The light strip is disposed around the mounting component and the storage component and is connected between the mounting component and the storage component. The power supply is disposed at a bottom portion of the storage component and is configured to supply power to the light strip.

In the storage device, the at least one elastic piece is connected between the mounting component and the storage component to form the storage space with the mounting component and the storage component, so that the at least one elastic piece is served as a protective structure capable of preventing articles accommodated in the storage space from falling, thereby reducing a potential safety hazard of the storage device. In addition, the at least one elastic piece is driven by the external force to deform and define the entrance, and a size of the entrance is adjusted according to different deformation degrees of the at least one elastic piece, so that the articles with different volumes are allowed to be taken out or placed in the storage space from the entrance.

Figure 1:
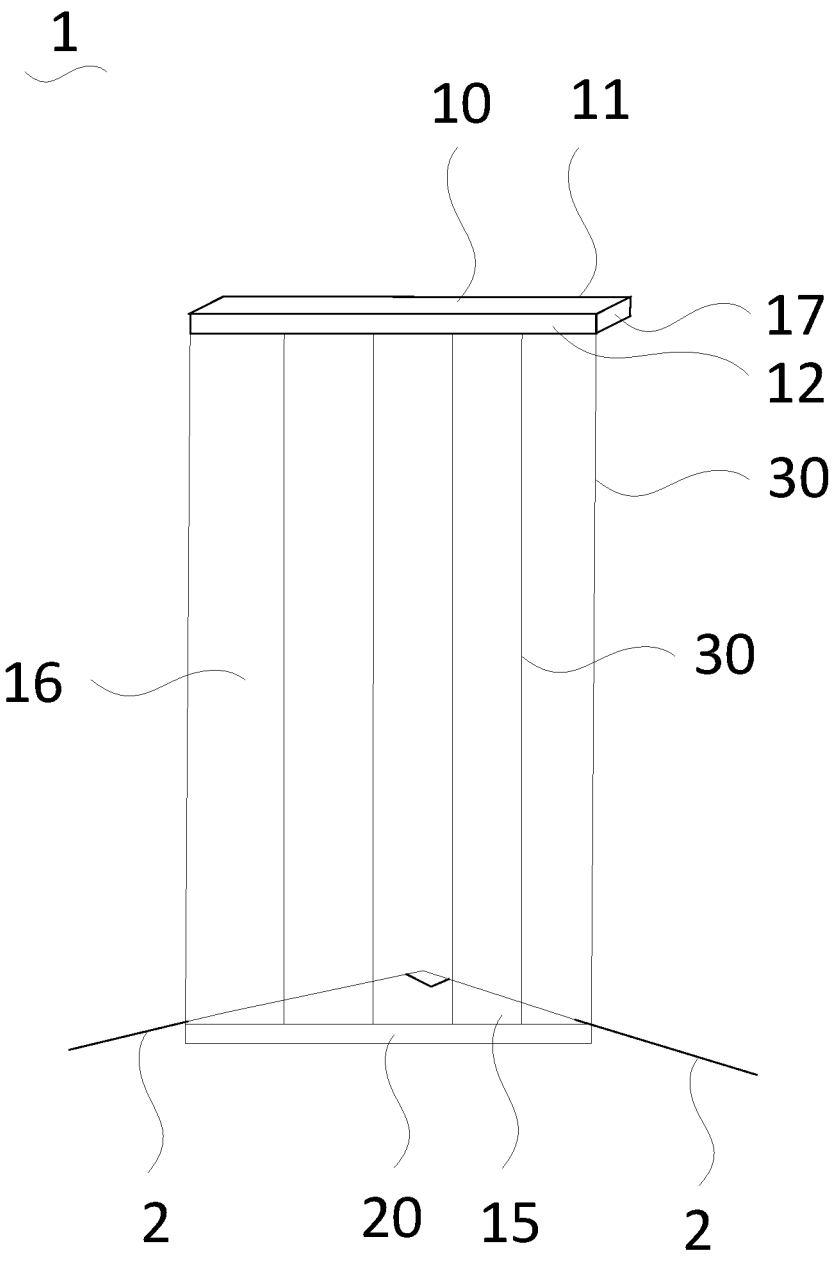
FIG. 1 is a front schematic diagram of a storage device according to a first embodiment of the present disclosure.

1—storage device; 2—wall surface; 10—mounting component; 20—storage component 30—elastic piece; 40—fixing piece; 50—power supply; 11—first inner side edge; 12—first outer side edge; 13—through hole; 14—limiting groove; 15—storage space; 16—entrance; 17—first connection edge; 21—second inner side edge; 22—second outer side edge; 31—elastic portion; 32—mounting portion; 33—limiting portion.

DETAILED DESCRIPTION

In order to make the above storage components, features, and advantages of the present disclosure clear and understood, specific embodiments of the present disclosure will be described in detail below with reference to the accompanying drawings. Many specific details are set forth in the following description to fully illustrate the present disclosure. However, the present disclosure can be implemented in many other ways different from that described herein, and those skilled in the art are able to do similar improvements without departing from the connotation of the present disclosure, and thus the present disclosure is not limited by the specific embodiments disclosed below.

It should be understood that in the description of the present disclosure terms such as "central", "lateral", "lengthways", "length", "width", "thickness", "upper", "lower", "left", "right", "vertical", "horizontal", "top", "bottom", "inner", "outer", "clockwise", "counterclockwise", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In addition, terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified.

It should be noted in the description of the present disclosure that, unless otherwise regulated and defined, terms such as "installation", "bonded", and "connection" shall be understood in broad sense, and for example, may refer to fixed connection or detachable connection or integral connection, may refer to mechanical connection or electrical connection, and may refer to direct connection or indirect connection through an intermediate medium or inner communication of two elements. For those of ordinary skill in the art, the meanings of the above terms in the present disclosure may be understood according to concrete conditions.

In the present disclosure, unless expressly stipulated and defined otherwise, the first feature is disposed "above" or "below" the second feature may mesa that the first feature directly contact the second feature, or the first feature does not directly contact the second feature but connected to the second feature through other features between them. Furthermore, the first feature is disposed "on", "above" or "over" the second feature means that the first feature may arrange directly above and obliquely above the second feature or it may merely indicate that a level of the first feature is greater than a level of the second feature. The first feature is disposed "below", "under", and "beneath" the second feature means that the first feature is disposed directly below and obliquely below the second feature, or it simply means that the level of the first feature is less than the level of second feature.

It should be noted that when one component is referred to as being "fixed on" or "disposed on" another component, it can be directly disposed on the other component or it may be indirectly fixed or disposed on the other component through a third component. When one component is said to be "connected to" another component, it may be directly connected to the other component or it may be indirectly connected to the other component through a third component.

As shown in FIG. 1, the present disclosure provides a storage device 1 mounted on wall surfaces 2 and configured to accommodate articles. The storage device 1 comprises a mounting component 10, a storage component 20, and at least one elastic piece 30. The mounting component 10 and the storage component 20 are mounted on the wall surfaces 2 at intervals in a gravity direction. The at least one elastic piece 30 is connected between the mounting component 10 and the storage component 20. The at least one elastic piece 30, the mounting component 10, and the storage component 20 are enclosed to define a storage space 15. Under driving of an external force, the at least one elastic pieces 30 is deformed to define an entrance 16 of the storage space 15.

In the storage device 1, the at least one elastic piece 30 is connected between the mounting component 10 and the storage component 20 to form the storage space 15 with the mounting component 10 and the storage component 20, so that the at least one elastic piece 30 is served as a protective structure capable of preventing the articles accommodated in the storage space 15 from falling, thereby reducing a potential safety hazard of the storage device 1. In addition, the at least one elastic piece 30 is driven by the external force to deform and define the entrance 16, and a size of the entrance 16 is adjusted according to different deformation degrees of the at least one elastic piece 30, so that the articles with different volumes are allowed to be taken out or placed in the storage space from the entrance 16.

For instance, the mounting component 10 and the storage component 20 are mounted on two wall surfaces 2, and the two wall surfaces 2 are connected. That is, the mounting component 10 and the placing piece 20 are mounted at a wall corner defined by the two wall surfaces 2, so that the storage device 1 is disposed at a corner position in a room, which facilitates a spatial layout of the room. For ease of description, the following embodiments are all described by using an example in which the mounting component 10 and the storage component 20 are mounted on the wall corner.

The mounting component 10 and the storage component 20 are made of metal, plastic, or other materials. Optionally, the mounting component 10 and the storage component 20 are made of the metal or metal alloy. The metal and the metal alloy have excellent mechanical strength, so that the storage component 20 stably supports the articles accommodated in the storage space 15.

Optionally, the mounting component 10 and the storage component 20 are fixed structures. Furthermore, the mounting component 10 and the storage component 20 are foldable structures, and the mounting component 10 and the storage component 20 are mounted on the wall surfaces 2 at intervals in the gravity direction when unfolded, so as to reduce volumes of the mounting component 10 and the storage component 20, thereby reducing a packaging volume of the storage device 1 and facilitating transportation.

For instance, the mounting component 10 is symmetrical and is foldable along a perpendicular bisector perpendicular to an outer side edge thereof, and the storage component 20 is symmetrical and is foldable along a perpendicular bisector perpendicular to an outer side edge thereof. In this way, a space occupied by the mounting component 10 and the storage component 20 is small when folded, so that the packaging volume of the storage device 1 is further reduced.

Of course, in some embodiments, the mounting component 10 and the storage component 20 are not symmetrical but are still foldable.

In addition, the mounting component 10 comprises two first foldable structures. The storage component 20*s* comprises two second foldable structures. The two first foldable structures are connected by at least one first hinge (or at least one first connecting rod, etc.). The two second foldable structures are connected by at least one second hinge (or at least one second connecting rod, etc.). The hinges are easy to obtain and have low connection cost.

The mounting component 10 and the storage component 20 are plate-shaped structures, and the mounting component 10 and the storage component 20 are disposed in parallel in the gravity direction. A shape of the storage component 20 is same as or different with a shape of the mounting component 10. The storage component 20 and the mounting component 10 are fan-shaped, right-angled triangle, or rectangular, which makes storage component 20 and the mounting component 10 easy to manufacture and improves production efficiency.

The mounting component 10 at least comprises an inner side edge and an outer side edge. The storage component 20 at least comprises an inner side edge and an outer side edge. In addition, at least one of the mounting component 10 and the storage component 20 comprises a connecting edge. If the mounting component 10 or the storage component 20 only comprises the inner side edge and the outer side edge thereof, then the inner side edge and the outer side edge thereof are connected to form an outer periphery of the mounting component 10 or the storage component 20. If the mounting component 10 or the storage component 20 comprises the inner side edge, the outer side edge, and the connecting edge at the same time, the inner side edge, the outer side edge, and the connecting edge thereof are combined to form the outer periphery of the mounting component 10 or the storage component 20.

For ease of labeling and illustration, the inner side edge of the mounting component 10 is defined as a first inner side edge 11, the outer side edge of the mounting component 10 is defined as a first outer side edge 12, the connecting edge of the mounting component 10 is defined as a first connecting edge 17, the inner side edge of the storage component 20 is defined as a second inner side edge 21, the outer side edge of the storage component 20 is defined as a second outer side edge 22, and the connecting edge of the storage component 20 is defined as a second connecting edge.

As shown in FIGS. 1-4, the first inner side edge and the second inner side edge refer edges facing the wall corner, and the first outer side edge and the second outer side edge refer to edges disposed outwards with respect to the first inner side edge and the second inner side edge. The first connecting edge is an edge connecting the first inner side edge and the first outer side edge, and the second connecting edge is an edge connecting the second inner side edge and the second outer side edge.

The first inner side edge and the second inner side edge may be right-angled edges, straight edges, curved edges or other forms of edge structures. The first outer side edge and the second outer side edge may be convex arc edges, concave arc edges, wavy edges or other forms of edge structures.

In some embodiments, as shown in FIG. 1, the first inner side edge 11 and the first outer side edge 12 of the mounting component 10 are disposed in parallel. The first inner side edge 11 and the first outer side edge 12 of the mounting component 10 are connected to the two wall surfaces 2 that are connected to define the wall corner.

In the embodiments, the mounting component 10 comprises the first connecting edge 17. The first inner side edge 11 and the first outer side edge 12 of the mounting component 10 are disposed in parallel and are connected between the two wall surfaces 2 that are connected to define the wall corner, so that the first inner side edge 11, the first outer side edge 12, and the first connecting edge 17 are enclosed to form the mounting component 10 having a smaller volume, which facilitates reducing a weight of the mounting component 10 and reducing manufacturing cost of the storage device 1.

Figure 2:
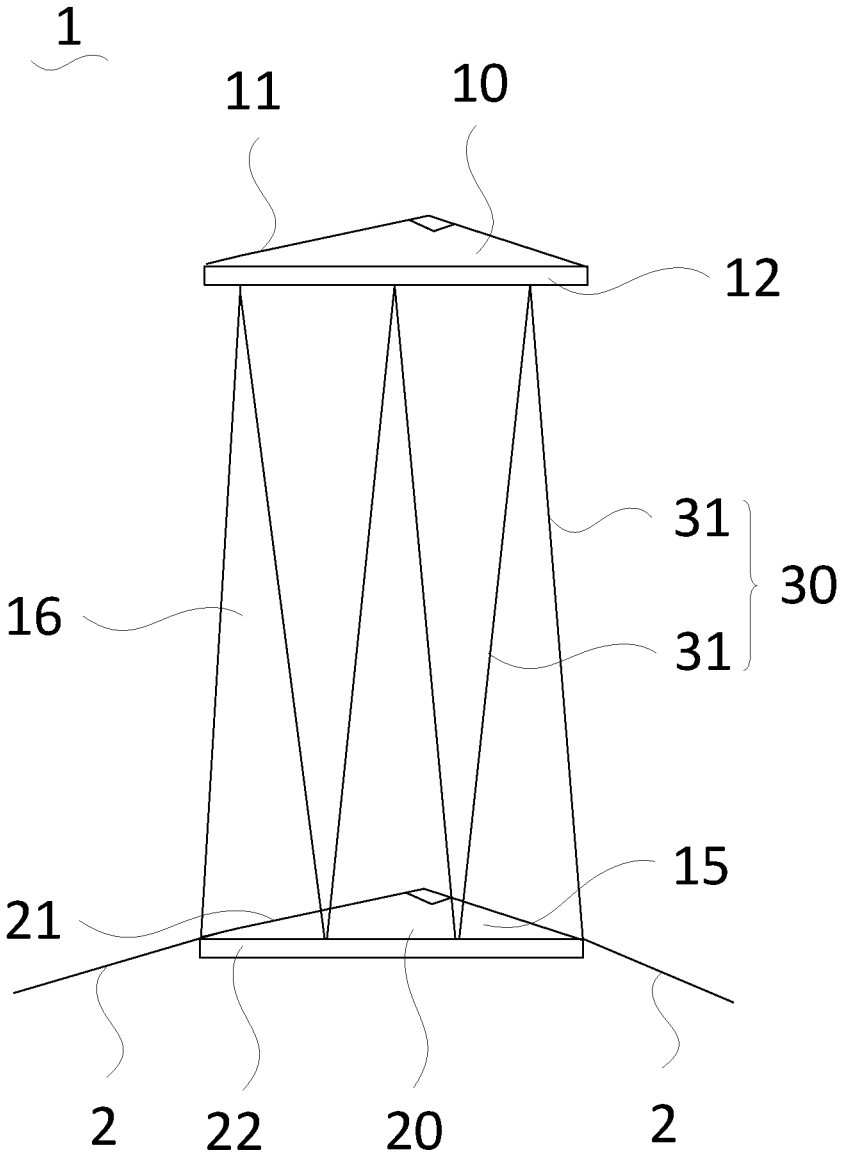
FIG. 2 is a front schematic diagram of the storage device according to a second embodiment of the present disclosure.
Figure 3:
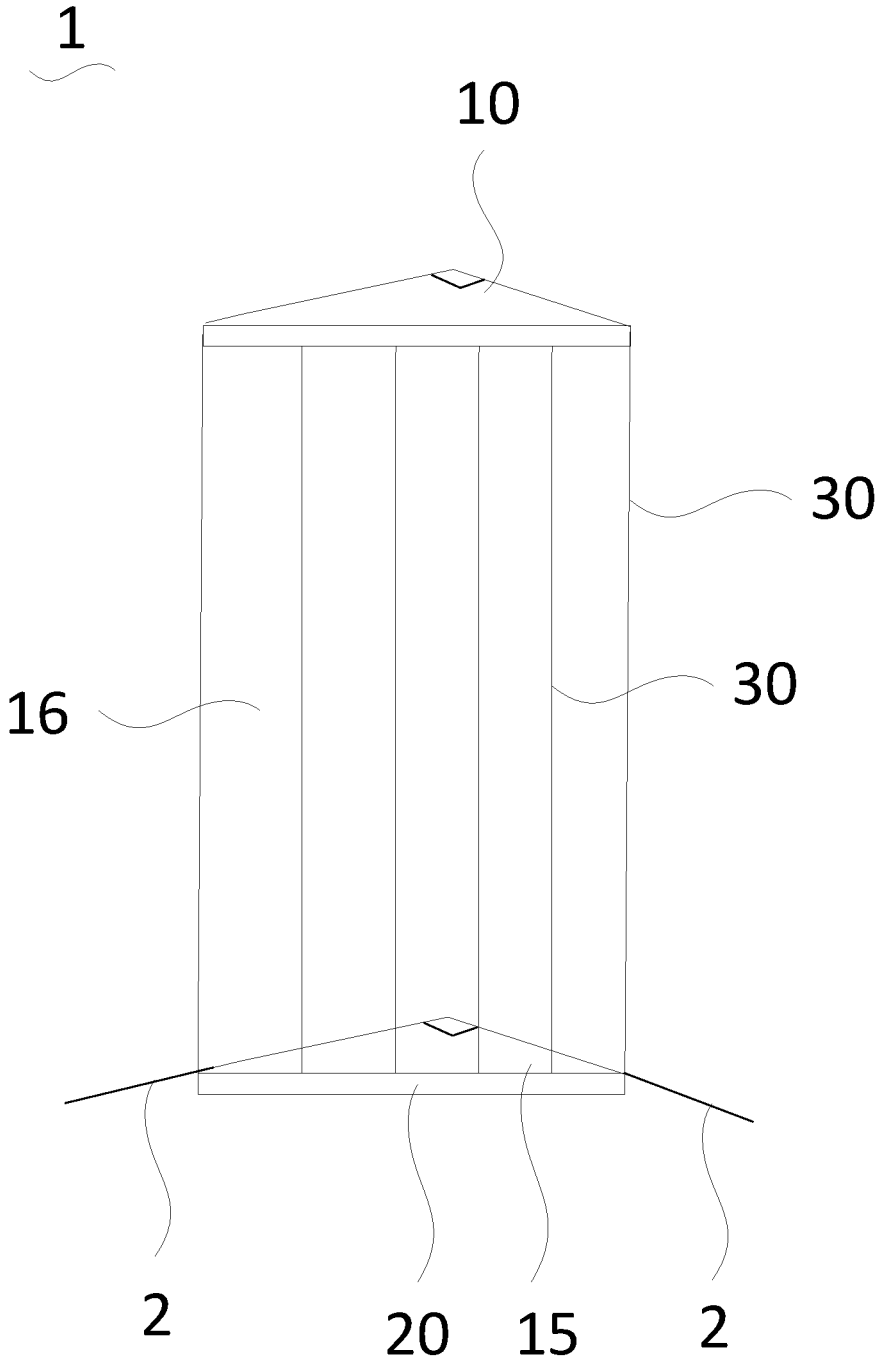
FIG. 3 is a front schematic diagram of the storage device according to a third embodiment of the present disclosure.
Figure 4:
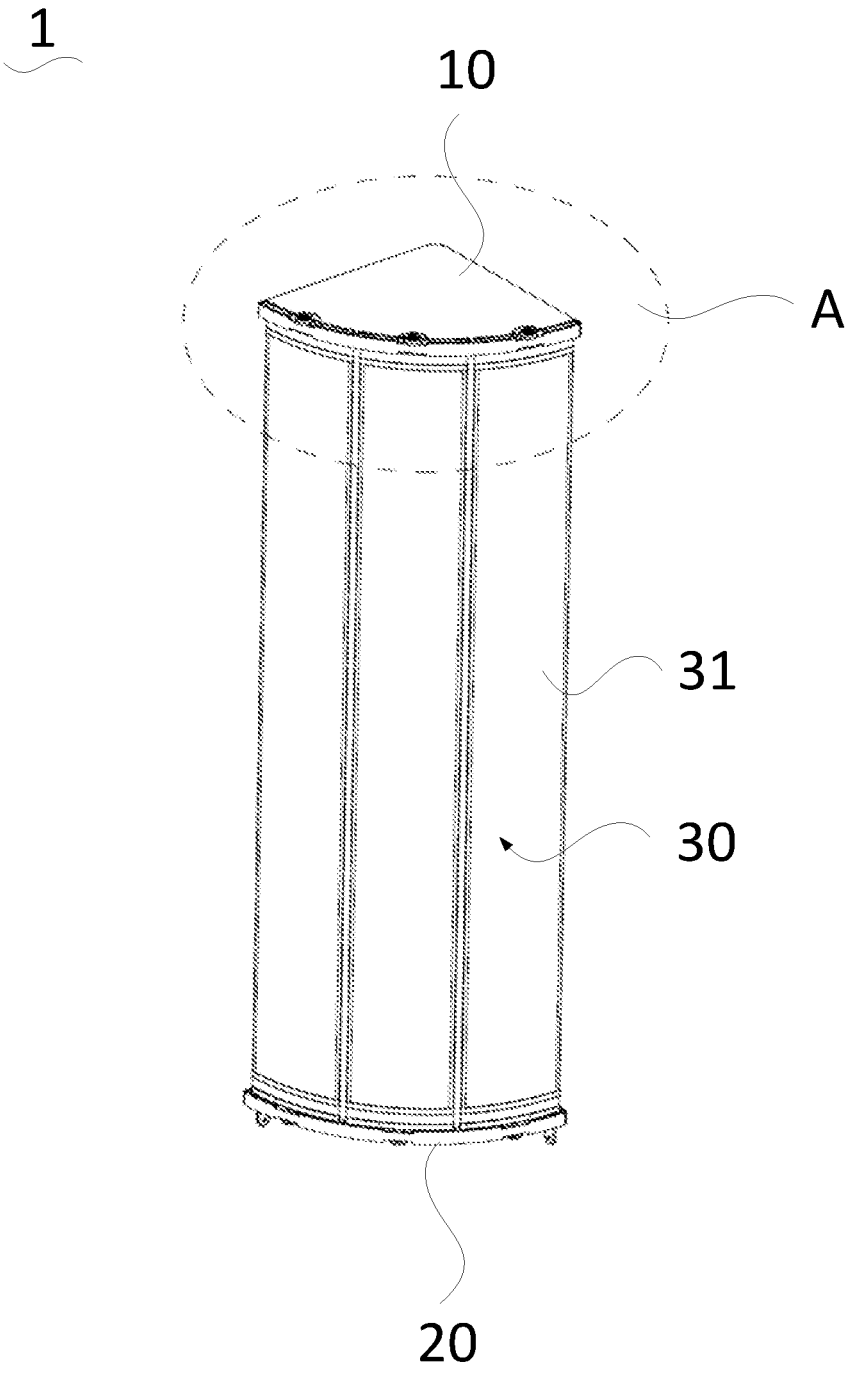
FIG. 4 is a front schematic diagram of the storage device according to a fourth embodiment of the present disclosure.

In some embodiments, as shown in FIGS. 2-4, at least the second inner side edge 21 of the storage component 20 is a right-angled edge. The second inner side edge 21 of the storage component 20 is configured to attach to the wall corner of a right angle. Optionally, the first inner side edge of the mounting component 10 and the second inner side edge 21 of the storage component 20 are right-angled edges.

Taking the second inner side edge 21 of the storage component 20 is the right-angled edge as an example, the second inner side edge of the storage component 20 comprises a first edge and a second edge. The first edge and the second edge are perpendicular to each other to form a right angle. The first edge and the second edge are respectively attached to the two wall surfaces 2. By configuring the second inner side edge of the storage component 20 to be the right-angled edge capable of being attached to wall corner of the right angle, a mounting stability of the storage component 20 is improved, thereby facilitating a placement of the articles accommodated in the storage component 20. For one embodiment in which the second inner side edge of the storage component 20 and the first inner side edge of the mounting component 10 are the right-angled edges, a mounting stability of the storage device 1 is further improved.

In some embodiments, a structure of the first outer side edge 12 of the mounting component 10 is same as a structure of the second outer side edge 22 of the storage component 20. The first outer side edge of the mounting component 10 and the second outer side edge of the storage component 20 are aligned and disposed in parallel in the gravity direction, so that the storage space is defined between the mounting component 10 and the storage component 20, and the at least one elastic piece limits a size of the storage space 15.

For ease of illustration, the following embodiments are described by using an example in which the shape of the mounting component 10 and the shape of the storage component 20 are the same and are both fan-shaped or isosceles right-angled triangles. In the embodiments, the inner side edge of the mounting component 10 and the inner side edge of the storage component 20 are the right-angled edges, the outer side edge of the mounting component 10 and the outer side edge of the storage component 20 are convex arc edges or straight edges, and neither the mounting component 10 nor the storage component 20 comprises the connecting edge.

In some embodiments, a connection between the second inner side edge 21 and the second outer side edge of the storage component 20 is chamfered, and/or a connection between the first inner side edge 11 and the first outer side edge 12 of the mounting component 10 is chamfered. Optionally, the connection between the second inner side edge 21 and the second outer side edge of the storage component 20 is chamfered, and the connection between the first inner side edge 11 and the first outer side edge 12 of the mounting component 10 is chamfered. In this way, the first inner side edge smoothly transitions to the first outer side edge, and the second inner side edge smoothly transitions to the second outer side edge, which avoid a situation that the user is scratched by sharp corners of the mounting component 10 and/or sharp corners of the storage component 20, and improves use safety.

Of course, in other embodiments, the connection between the second inner side edge 21 and the second outer side edge of the storage component 20 is not chamfered, and the connection between the first inner side edge 11 and the first outer side edge 12 of the mounting component 10 is not chamfered.

In some embodiments, at least one of the mounting component 10 and the storage component 20 comprises at least one hollow portion for weight reduction, which reduces the weight of the storage device 1 and reduces the potential safety hazard of the storage device 1 falling due to mounting errors.

Optionally, the at least one hollow portion is formed on the storage component 20. According to difference us environments, the at least one hollow portion may have a drainage function in addition to reducing the weight of the storage device. For example, when the storage device 1 is mounted in a bathroom or outdoor, the storage space 15 is prone to water accumulation. At this time, the at least one hollow portion defined on the storage component 20 may discharge accumulated water in the storage space 15 to prevent the accumulated water from damage the storage component 20 and the articles stored therein.

Furthermore, one or more hollow portions are defined on both of the mounting component 10 and the storage component 20. When hollow portions are defined on the mounting component 10 and the storage component 20, shapes of the hollow portions may be same or different, which are determined according to actual needs.

Figure 5:
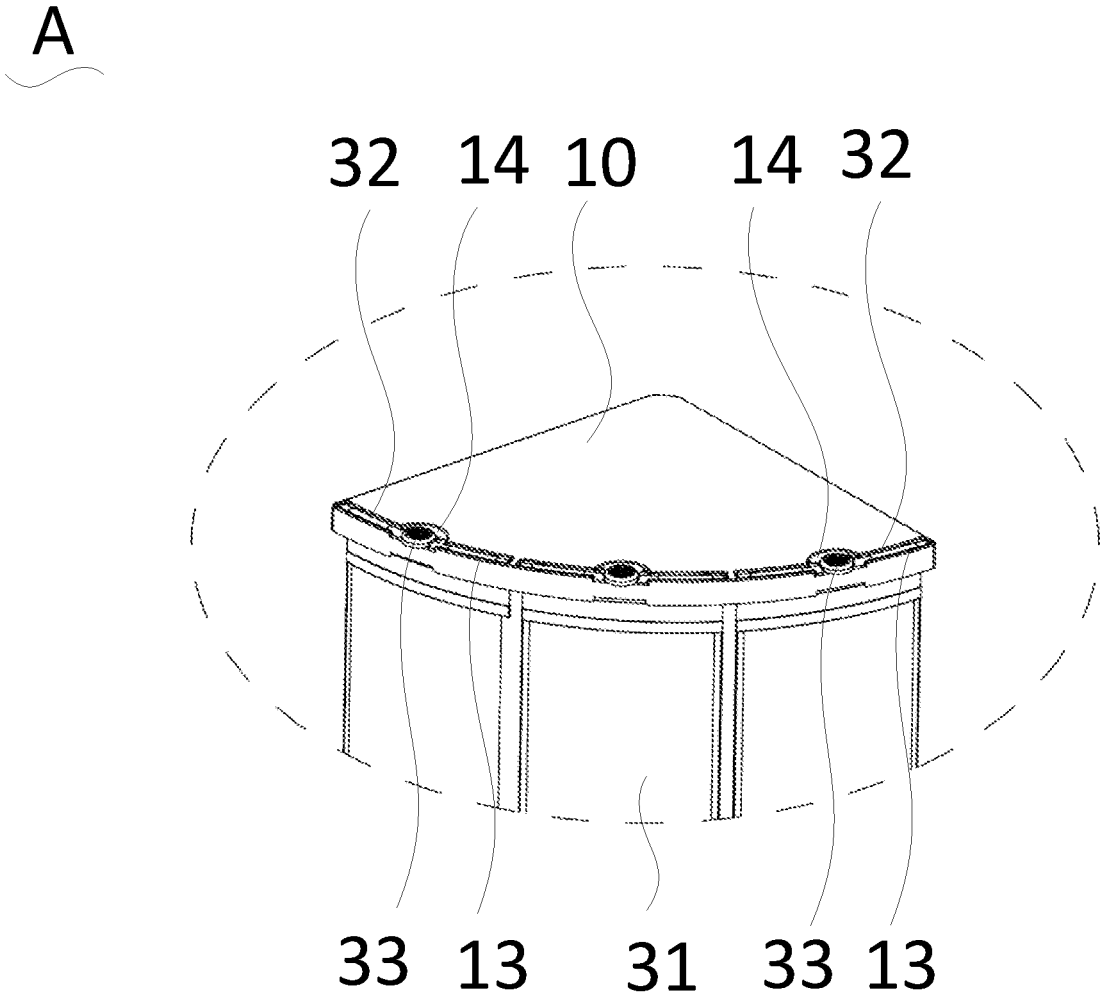
FIG. 5 is an enlarged schematic diagram of portion A of the storage device shown in FIG. 4.

As shown in FIG. 1, the shape of the mounting component 10 is different with the shape of the storage component 20, and the mounting component 10 comprises the first inner side edge, the first outer side edge, and the first connecting edge, while the storage component only comprises the second inner side edge and the second outer side edge. The first inner side edge of the mounting component 10 is parallel to the first outer side edge and is connected between the two wall surfaces 2 that are connected to define the wall corner. The storage component 20 is in a shape of an isosceles right triangle having the right-angled edge (i.e. the first connecting edge). In FIG. 2 and FIG. 3, the shape of the mounting component 10 is same as the storage component 20, and both of the mounting component 10 and the storage component 2 are in the shape of the isosceles right triangle having the right-angled edge. In FIG. 4 and FIG. 5, the shape of the mounting component 10 is same as the storage component 20, and both of the mounting component 10 and the storage component 2 are fan-shaped with the right-angle edges.

Optionally, the at least one elastic piece 30 is an elastic rope, an elastic net, an elastic cloth, etc., which is determined according to actual needs.

In some embodiments, the at least one elastic piece 30 comprises only one elastic piece 30 and the one elastic piece 30 is an elastic rope. The elastic piece 30 is staggered and alternately connected to the mounting component 10 and the storage component 20. Portions of the one elastic piece 30 located between the mounting component 10 and the storage component 20 are defined as elastic portions 31. Any one of the elastic portions 31 is deformable to define the entrance 16 of the storage space.

Specifically, a position of the entrance is not fixed. Specifically, each two adjacent elastic portions 31 are deformed to define the entrance with the mounting component 10 and the storage component 20, or one of the elastic portions 31 closet to a corresponding wall surface is deformed to define the entrance with the mounting component 10 and the storage component 20.

Optionally, the one elastic piece 30 is staggered and alternately pass through the mounting component 10 and the storage component 20. Alternatively, the one elastic piece 30 do not pass through the mounting component 10 and the storage component 20, but is only staggered and alternately connected between the mounting component 10 and the storage component 20.

By configuring the one elastic piece 30 to be the elastic rope, and the elastic rope 30 is staggered and alternately connected to the mounting component 10 and the storage component 20, a structure of the storage device 1 is simplified and the storage device 1 is easy to mount.

Furthermore, in some embodiments, through holes 13 are defined on the mounting component 10 and the storage component 20. The through holes 13 defined on the mounting component 10 are staggered with the through holes 13 defined on the storage component 20. The one elastic piece 30 alternately passes through the through holes 13 defined on the mounting component 10 and the through holes 13 defined on the storage component 20 to connect the mounting component 10 with the storage component 20. The arrangements of the through holes 13 facilitate connecting of the one elastic piece 30 and improves stability and reliability of mounting of the one elastic piece 30.

As shown in FIGS. 3-5, in some embodiments, the at least one elastic piece 30 comprises at least two elastic pieces 30. The at least two elastic pieces 30 are disposed along an outer side edge of the mounting component 10. Specifically, the position of the entrance is not fixed. For instance, each two adjacent elastic pieces 30 are deformed to define the entrance with the mounting component 10 and the storage component 20, or one of the elastic pieces 30 closet to a corresponding wall surface is deformed to define the entrance with the mounting component 10 and the storage component 20.

In the embodiment, the at least two elastic pieces 30 are connected between the mounting component 10 and the storage component 20 in the gravity direction, and do not pass through the mounting component 10 and the storage component 20, or each of the elastic pieces 30 passes through the mounting component 10 and the storage component 20 in the gravity direction.

By arrangements of the at least two elastic pieces 30, the articles stored in the storage space 15 are prevented from falling. Moreover, the entrance is define by the at least two elastic pieces 30, thus making the position of the entrance being adjustable and making it easy to place in or taken out the articles.

Furthermore, in some embodiments, through holes 13 are defined on the mounting component 10 and the storage component 20. The through holes 13 defined on the mounting component 10 are one-to-one corresponding to the at least two elastic pieces 30. The through holes 13 defined on the storage component 20 are one-to-one corresponding to the at least two elastic pieces 30. Each of the elastic pieces 30 passes through a corresponding through hole defined on the mounting component 10 and a corresponding through hole defined on the storage component 20. The arrangements of the through holes 13 facilitate connecting of the at least two elastic pieces 30 and improves stability and reliability of mounting of the at least two elastic pieces 30.

Furthermore, in some embodiments, the at least two elastic pieces 30 are elastic ropes. Each of the elastic pieces 30 is fixed to the corresponding through hole 13 defined on the mounting component 10 and the corresponding through hole defined on the storage component 20 by knotting. The elastic ropes are easy to obtain, and a fixing method thereof is simple and easy to operate, making the elastic ropes easy to mount.

As shown in FIGS. 5-9, in some embodiments, the through holes 13 defined on the mounting component 10 and the through holes 13 defined on the storage component 20 are stepped holes. Each of the elastic pieces 30 comprises an elastic portion 31 and mounting portions 32 disposed at two opposite ends of the elastic portion 31. Each elastic portion 31 is an elastic net. Each of the mounting portions 32 passes through a corresponding through hole 13 and is snapped on a hole wall of the corresponding through hole 13.

Each of the mounting portions 32 is snapped on the hole wall of the corresponding through hole 13, which is simple and easy to operate, making it easy to assemble the storage device 1. Moreover, each of the mounting portion 32 are shielded by the hole wall of the corresponding through hole 13, which improves an aesthetics of the storage device 1.

Figure 8:
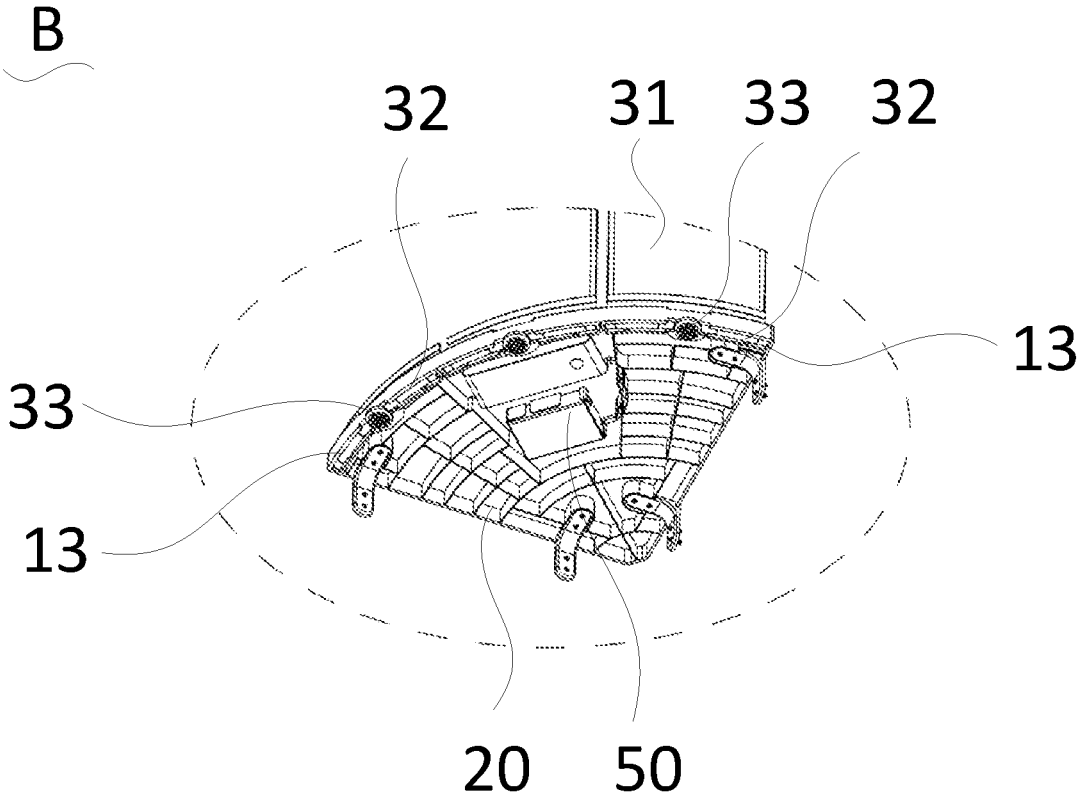
FIG. 8 is an enlarged schematic diagram of portion B of the storage device shown in FIG. 4.
Figure 9:
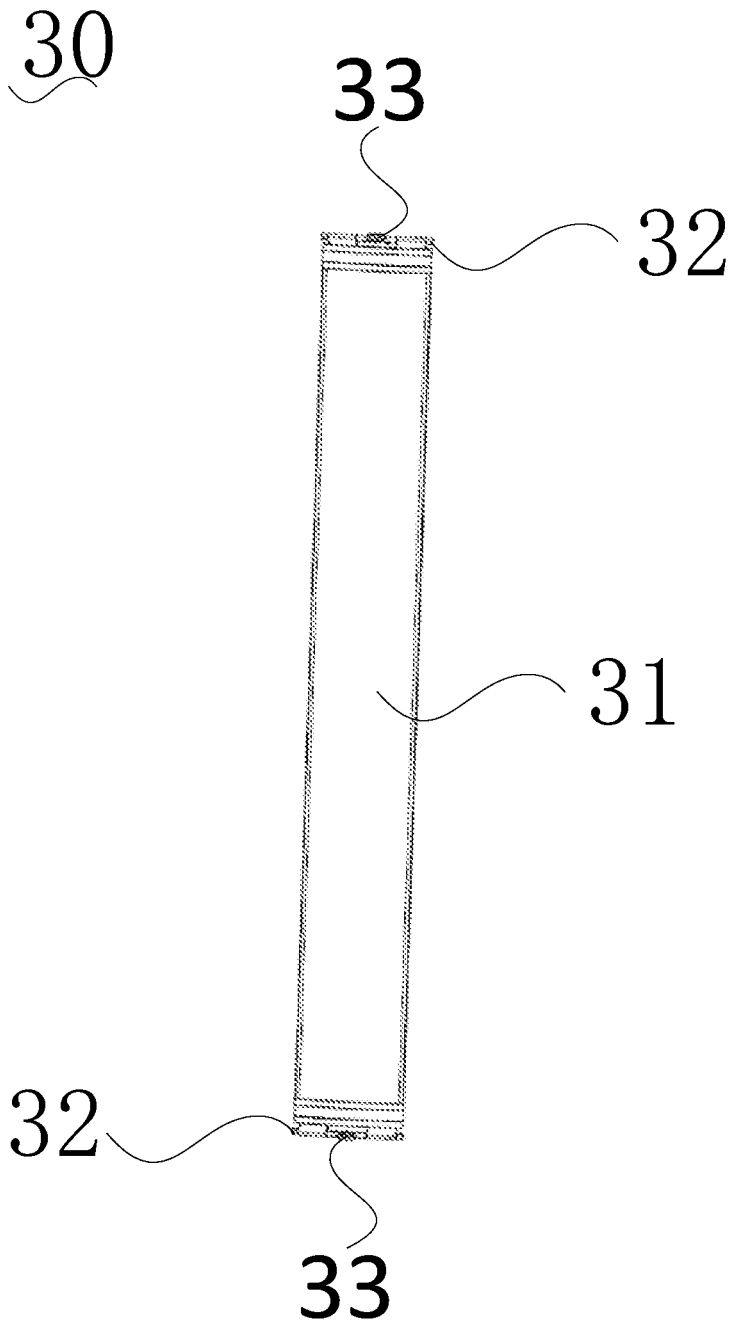
FIG. 9 is a schematic diagram of an elastic portion of the storage device shown in FIG. 4.

In some embodiments, as shown in FIGS. 5 and 8, limiting grooves 14 are defined on the mounting component 10 and the storage component 20. The limiting grooves 14 are one-to-one communicated with the through holes 13. Each of the elastic pieces 30 further comprises limiting portions 33 respectively connected to the mounting portions 32 thereof, and each of the limiting portions 33 is located in a corresponding limiting groove 14.

Each of the limiting portions 33 is fixedly connected or detachably connected to the corresponding mounting portion 32, which is determined according to actual needs.

By arrangements of the limiting portions 33 one-to-one limited in the limiting grooves 14, each of the mounting portions 32 is prevented from separating from the corresponding through hole 13 when a corresponding elastic portion 31 is stretched and deformed, which improves mounting reliability.

Figure 6:
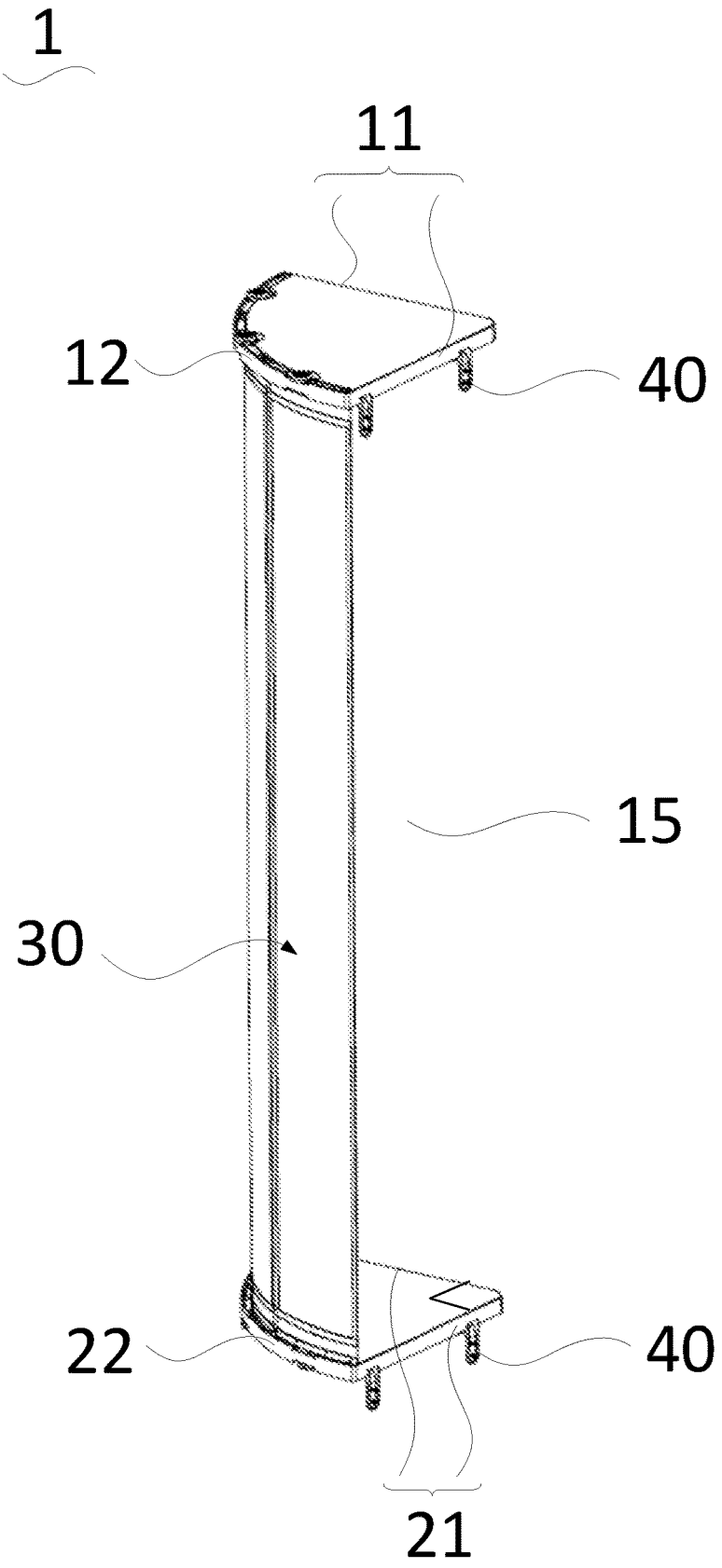
FIG. 6 is a side schematic diagram of the storage device shown in FIG. 4.

As shown in FIG. 6, in some embodiments, fixing pieces 40 are disposed on the mounting component 10 and the storage component 20. The fixing pieces 40 are configured to connect to the wall surfaces 2.

The fixing pieces 40 are detachably connected to the wall surfaces 2 through connecting pieces such as screws or pin shafts. Generally, the fixing pieces 40 are disposed on the first inner side edge of the mounting component 10 and the second inner side edge of the storage component 20. When the first inner side edge of the mounting component 10 and the second inner side edge of the storage component 20 are attached to the wall corner, the fixing pieces 40 disposed on the mounting component 10 and the storage component 20 are also attached to the wall corner for mounting.

Figure 7:
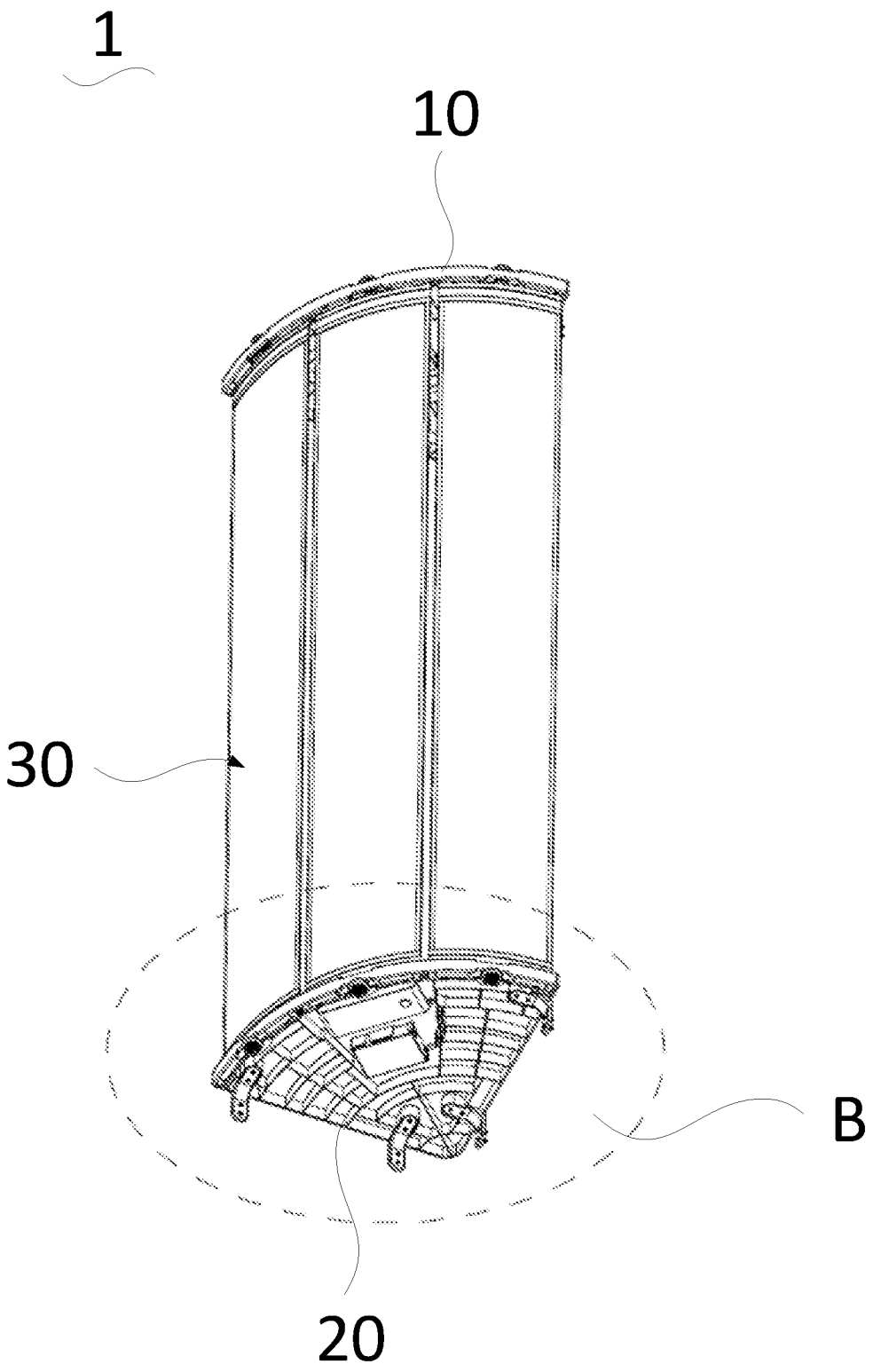
FIG. 7 is a bottom schematic diagram of the storage device shown in FIG. 4.

In some embodiments, as shown in FIG. 7, the storage device 1 further comprises a power supply 50 and a light strip. The light strip is disposed around the mounting component 10 and the storage component 20 and is connected between the mounting component 10 and the storage component 20. The power supply 50 is disposed at a bottom portion of the storage component 20 and is configured to supply power to the light strip.

Specifically, a portion of the light strip disposed around the mounting component 10 is located at the bottom portion of the mounting component 10, a portion of the light strip disposed around the storage component 20 is located on the bottom portion of the storage component 20, and portions of the light strip disposed between the mounting component 10 and the storage component 20 are parallel to the at least two elastic pieces 30. By arrangement of the light strip and the power supply 50, the storage device 1 plays a decorative role and has better aesthetics.

In the storage device 1, the at least one elastic piece 30 is connected between the mounting component 10 and the storage component 20 to form the storage space 15 with the mounting component 10 and the storage component 20, so that the at least one elastic piece 30 is served as the protective structure capable of preventing the articles accommodated in the storage space 15 from falling, thereby reducing the potential safety hazard of the storage device 1.

In addition, the at least one elastic piece 30 is driven by the external force to deform and define the entrance 16, and the size of the entrance 16 is adjusted according to different deformation degrees of the at least one elastic piece 30, so that the articles with different volumes are allowed to be taken out or placed in the storage space 15 from the entrance 16.

Technical features of the above-mentioned embodiments can be combined arbitrarily. For the sake of brevity, all possible combinations of the technical features in the above-mentioned embodiments are not described. However, as long as there is no contradiction between the combinations of these technical features, the combinations should be considered to be within the scope of the specification.

The above-mentioned embodiments only represent some embodiments of the present disclosure. The descriptions thereof are specific and detailed, but should not be construed as a limitation of the scope of the present disclosure. It should be pointed out that for those of ordinary skill in the art, without departing from the concept of the present disclosure, modifications and improvements can be made. The modifications and the improvements belong to the protection scope of the present disclosure. Therefore, the protection scope of the present disclosure should be subject to the attached claims.

What is claimed is:

1. A storage device, comprising:

a mounting component, a storage component, and at least one elastic piece;

wherein the mounting component and the storage component are mounted on wall surfaces at intervals in a gravity direction; the at least one elastic piece is connected between the mounting component and the storage component; the at least one elastic piece, the mounting component, and the storage component are enclosed to define a storage space; under driving of an external force, the at least one elastic piece is deformed to define an entrance of the storage space;

wherein the mounting component and the storage component are foldable structures; the mounting component and the storage component are mounted on the wall surfaces at intervals in the gravity direction when unfolded;

wherein the mounting component is symmetrical and is foldable along a perpendicular bisector perpendicular to an outer side edge thereof; the storage component is symmetrical and is foldable along a perpendicular bisector perpendicular to an outer side edge thereof.

2. The storage device according to claim 1, wherein the at least one elastic piece comprises only one elastic piece and the one elastic piece is an elastic rope; the elastic piece is staggered and alternately connected to the mounting component and the storage component; portions of the one elastic piece located between the mounting component and the storage component are defined as elastic portions; any one of the elastic portions is deformable to define the entrance of the storage space.

3. The storage device according to claim 2, wherein through holes are defined on the mounting component and the storage component; the through holes defined on the mounting component are staggered with the through holes defined on the storage component; the one elastic piece alternately passes through the through holes defined on the mounting component and the through holes defined on the storage component to connect the mounting component with the storage component.

4. The storage device according to claim 1, wherein the at least one elastic piece comprises at least two elastic pieces; the at least two elastic pieces are disposed along an outer side edge of the mounting component.

5. The storage device according to claim 4, wherein through holes are defined on the mounting component and the storage component; the through holes defined on the mounting component are one-to-one corresponding to the at least two elastic pieces; the through holes defined on the storage component are one-to-one corresponding to the at least two elastic pieces;

each of the elastic pieces passes through a corresponding through hole defined on the mounting component and a corresponding through hole defined on the storage component.

6. The storage device according to claim 5, wherein the at least two elastic pieces are elastic ropes; each of the elastic pieces is fixed to the corresponding through hole defined on the mounting component and the corresponding through hole defined on the storage component by knotting.

7. The storage device according to claim 5, wherein the through holes defined on the mounting component and the through holes defined on the storage component are stepped holes; each of the elastic pieces comprises an elastic portion and mounting portions disposed at two opposite ends of the elastic portion; each elastic portion is an elastic net; each of the mounting portions passes through a corresponding through hole and is snapped on a hole wall of the corresponding through hole.

8. The storage device according to claim 7, wherein limiting grooves are defined on the mounting component and the storage component; the limiting grooves are one-to-one communicated with the through holes; each of the elastic pieces further comprises limiting portions respectively connected to the mounting portions thereof; each of the limiting portions is located in a corresponding limiting groove.

9. The storage device according to claim 1, wherein the mounting component comprises two first foldable structures; the storage component comprises two second foldable structures; the two first foldable structures are connected by at least one first hinge; the two second foldable structures are connected by at least one second hinge.

10. The storage device according to claim 1, wherein an inner side edge and an outer side edge of the mounting component are disposed in parallel; the inner side edge and the outer side edge of the mounting component are connected to a wall corner; the wall surfaces are connected to define the wall corner.

11. The storage device according to claim 1, wherein an inner side edge of the storage component is a right-angled edge; the inner side edge of the storage component is configured to attached to a wall corner of a right angle.

12. The storage device according to claim 1, wherein a structure of an outer side edge of the mounting component is same as a structure of an outer side edge of the storage component; the outer side edge of the mounting component and the outer side edge of the storage component are aligned and disposed in parallel in the gravity direction.

13. The storage device according to claim 1, wherein a shape of the storage component is same as a shape of the mounting component; the storage component and the mounting component are fan-shaped, right-angled triangle, or rectangular.

14. The storage device according to claim 1, wherein a shape of the storage component differs from a shape of the mounting component; the storage component and the mounting component are fan-shaped, right-angled triangle, or rectangular.

15. The storage device according to claim 1, wherein a connection between an inner side edge and an outer side edge of the storage component is chamfered; and/or a connection between an inner side edge and an outer side edge of the mounting component is chamfered.

16. The storage device according to claim 1, wherein fixing pieces are disposed on the mounting component and the storage component; the fixing pieces are configured to connect to the wall surfaces.

17. The storage device according to claim 1, wherein at least one of the mounting component and the storage component comprises at least one hollow portion for weight reduction.

18. A storage device, comprising:

a mounting component, a storage component, and at least one elastic piece;

wherein the mounting component and the storage component are mounted on wall surfaces at intervals in a gravity direction; the at least one elastic piece is connected between the mounting component and the storage component; the at least one elastic piece, the mounting component, and the storage component are enclosed to define a storage space; under driving of an external force, the at least one elastic piece is deformed to define an entrance of the storage space;

wherein the at least one elastic piece comprises at least two elastic pieces; the at least two elastic pieces are disposed along an outer side edge of the mounting component;

wherein through holes are defined on the mounting component and the storage component; the through holes defined on the mounting component are one-to-one corresponding to the at least two elastic pieces; the through holes defined on the storage component are one-to-one corresponding to the at least two elastic pieces; each of the elastic pieces passes through a corresponding through hole defined on the mounting component and a corresponding through hole defined on the storage component.

19. A storage device, comprising:

a mounting component, a storage component, and at least one elastic piece;

wherein the mounting component and the storage component are mounted on wall surfaces at intervals in a gravity direction; the at least one elastic piece is connected between the mounting component and the storage component; the at least one elastic piece, the mounting component, and the storage component are enclosed to define a storage space; under driving of an external force, the at least one elastic piece is deformed to define an entrance of the storage space;

wherein the storage device further comprises a power supply and a light strip; the light strip is disposed around the mounting component and the storage component and is connected between the mounting component and the storage component; the power supply is disposed at a bottom portion of the storage component and is configured to supply power to the light strip.

* * * * *